United States Patent [19]

Chalmers

[11] 4,371,228

[45] Feb. 1, 1983

[54] ELECTRIC CONNECTOR

[76] Inventor: Walter M. Chalmers, 12 Clive Rd., Dundee, Scotland

[21] Appl. No.: 186,385

[22] Filed: Sep. 11, 1980

Related U.S. Application Data

[63] Continuation-in-part of Ser. No. 78,208, Sep. 24, 1979, abandoned.

[30] Foreign Application Priority Data

Sep. 27, 1978 [GB] United Kingdom ..... 38273/78

[51] Int. Cl.[3] ..... H01R 13/42

[52] U.S. Cl. ..... 339/221 R

[58] Field of Search ..... 339/217 R, 217 S, 220 R, 339/221 R

[56] References Cited

U.S. PATENT DOCUMENTS

| | | | |
|---|---|---|---|
| 2,329,471 | 9/1943 | King | 339/220 R |
| 3,444,504 | 5/1969 | Lynch et al. | 339/221 R X |
| 3,720,907 | 3/1973 | Asick | 339/217 S X |

*Primary Examiner*—Eugene F. Desmond

*Attorney, Agent, or Firm*—Kerkam, Stowell, Kondracki & Clarke

[57] ABSTRACT

An electric connector comprises a housing arranged to receive a number of contact members arranged to be inserted and removed from one end of the housing. Each contact member is located in an aperture defining a retaining shoulder, a contact-locating portion, and a slot communicating with and parallel to the aperture. Each contact member has a terminal portion, a contact portion, and a retaining portion, the latter arranged to extend into the slot and prevent withdrawal of the contact member by becoming wedged across the aperture.

6 Claims, 7 Drawing Figures

ELECTRIC CONNECTOR

REFERENCE TO RELATED APPLICATION

This application is a continuation-in-part of my application Ser. No. 078,208, filed Sept. 24, 1979, now abandoned.

This invention relates to electric connectors of the type comprising a housing containing a plurality of parallel contact members.

Electric connectors of this type are well-known and take many forms, including edge-connectors for printed circuit boards and many other types of multiple-contact connector. Although a few connectors of this type have the contacts moulded into place in a housing of electrically-insulating material, the majority are made so that the contacts may be inserted into the housing as a separate assembly operation. It is often necessary to be able to replace the contacts if they become damaged, and this is usually done by extracting a damaged contact from the end of the housing through which it was inserted. However, whilst the contacts are in position they must not be able to fall, or be pulled, out of the housing. Hence various means are provided for retaining the contacts, usually requiring the use of at least one resilient tongue formed on each contact to engage with a shoulder on the housing.

The modern trend is to make connectors smaller, and this process has reached the stage where the space occupied by the usual contact retaining means in the housing becomes important in determining the overall size of the connector.

According to the present invention there is provided an electric connector of the type comprising a housing of electrically insulating material having a plurality of contact members extending parallel to one another and arranged to be inserted into and withdrawn from the housing from one end thereof, in which the housing includes, for each contact member, an aperture extending through the housing and defining a retaining shoulder, a contact-locating region, and a slot communicating with the contact-locating region and extending from the said one end of the housing for at least part of the length of that region, and in which each contact member includes a terminal portion arranged to project from the end of the housing remote from this one end, a contact portion arranged to be located in the contact-locating region so as to cooperate with a plug member inserted into the housing from said one end, and a retaining portion having a sharpened end arranged to extend into said slot and shaped so as to become wedged across the aperture to prevent the withdrawal of the contact member through the said one end of the housing.

An embodiment of the invention will now be described with reference to the accompanying drawings, in which.

The drawings relate to an edge connector in which an insulating housing contains one or two parallel rows of contact members. The drawings illustrate part of such a connector in which, for clarity, only one contact member is shown.

Figure 1:
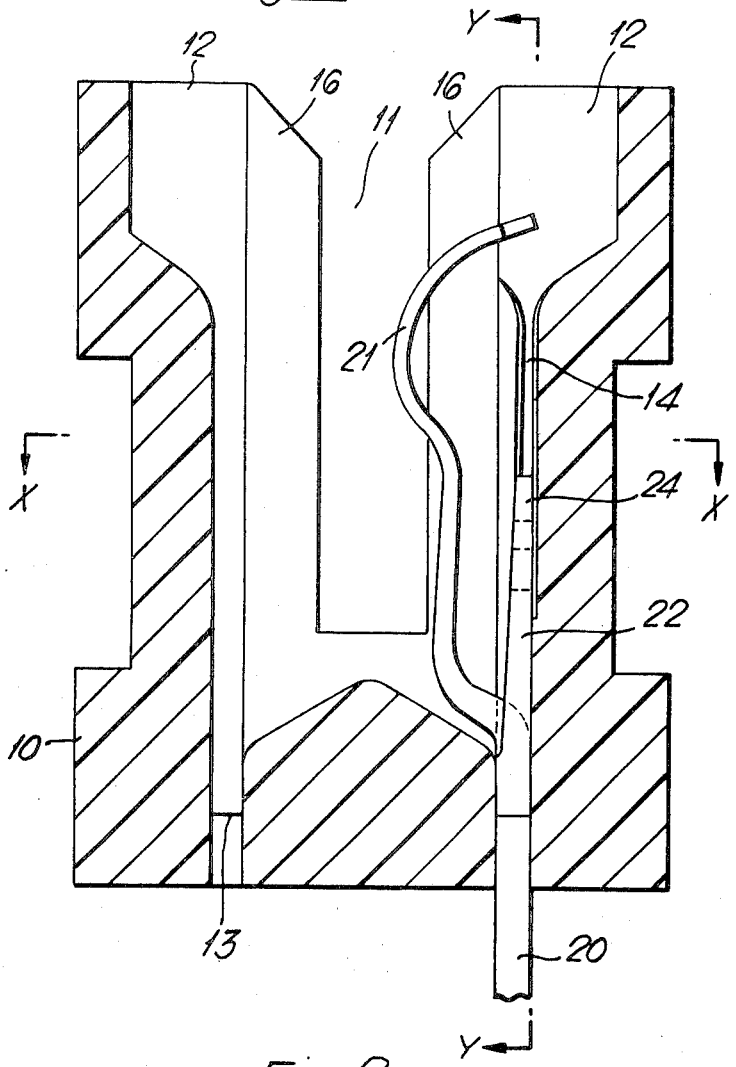
FIG. 1 is a sectional side view of a connector.
Figure 2:
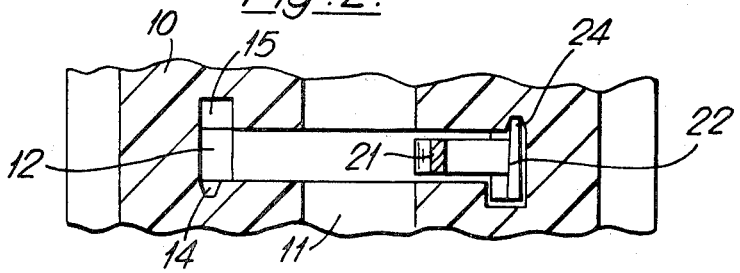
FIG. 2 is a sectional view of the connection along the line X—X of FIG. 1.
Figure 3:
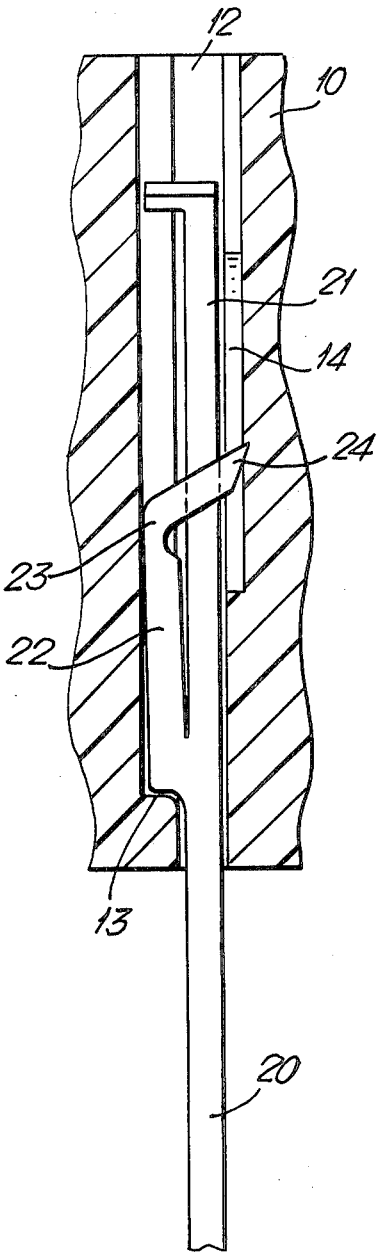
FIG. 3 is a sectional view of the connector along the line Y—Y of FIG. 1.

Referring now to FIGS. 1, 2 and 3, a housing 10 of electrically insulating material is formed with a central slot 11 arranged to accommodate a printed circuit board (not shown). Extending transversely from opposite sides of the central slot are a plurality of transverse apertures 12 in each of which may be located a contact member. Each aperture extends right through the housing, and near one end is shaped to define a retaining shoulder 13. The middle part of each aperture 12 is the contact-locating region in which the main part of the contact is located, and this part, as already stated, communicates with the central slot 11 of the housing. Formed as part of each aperture, and extending from the open end of the housing, is a slot 14 having a tapered cross-section. This communicates with the aperture 12 and extends for part of, but not all, the length of the aperture. In the embodiment illustrated the tapered slot extends sideways from the aperture 12. Also extending from the aperture 12 opposite to the tapered slot 14 is a wider slot 15 intended to contain part of the contact member as will be described below.

As is usual with edge connectors of the type illustrated, the housing 10 also provides, for each contact member, a ledge 16 under which the free end of the contact member is retained. This serves to limit the movement of the contact member into the central slot 11, and also serves to pre-tension the contact member.

The form of the contact member itself will also be apparent from FIGS. 1 to 3. A terminal portion 20 of the contact member extends through the aperture 12 in the bottom of the housing to provide a termination for a conductor. The main contact portion 21 of the contact member is, in the embodiment illustrated, formed into the usual hook shape and projects into the central slot 11 in the housing. Also extending from the terminal portion 20 of the contact member is a retaining portion 22. This is shaped where it joins the terminal portion so as to engage the shoulder 13 when the contact member is in position as shown in FIG. 3, and extends parallel to the contact portion. The extremity of the retaining portion is weakened at 23 and is bent transversely to its length so as to enter the tapered slot 14. The end 24 of portion 22 is shaped to provide a sharp edge which may engage the material of the housing. The weakened portion 23 of the retaining portion 22 also gives some slight resilience to the end 24.

Figure 4:
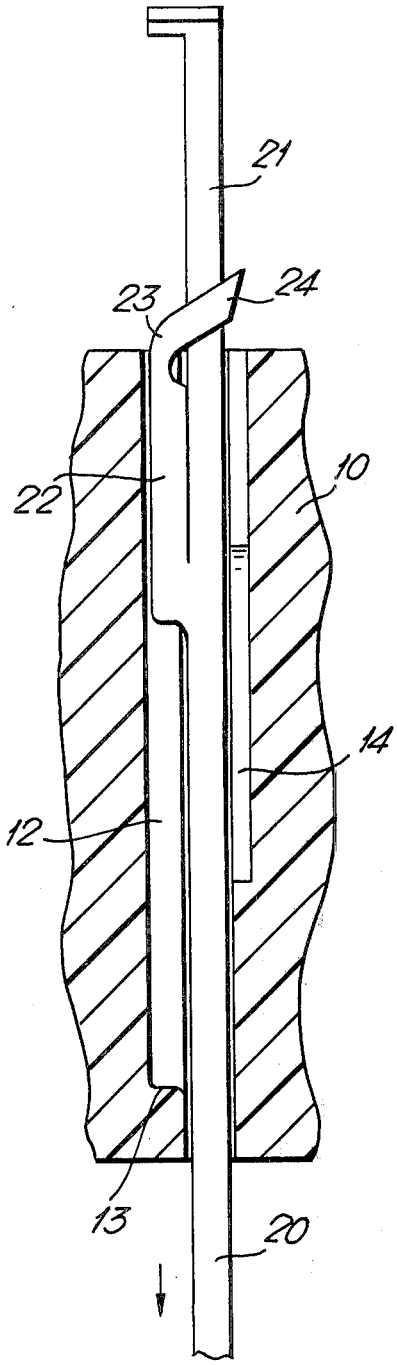
FIGS. 4 and 5 are drawings similar to that of FIG. 3 showing the assembly of the connector.
Figure 5:
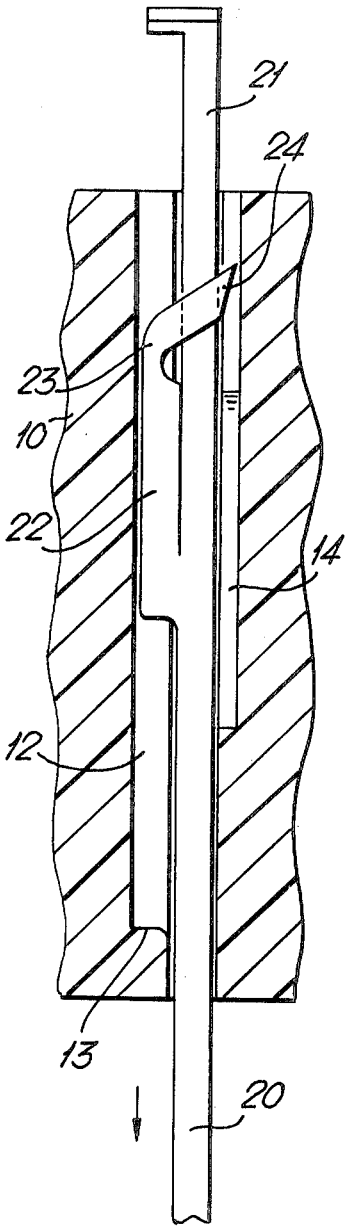

FIGS. 4 and 5 illustrate the insertion of a contact member into an aperture 12 of the housing 10. The contact member is inserted through the open end of the housing so that the terminal portion 20 passes through the housing. As the contact member is moved into position the end 24 of retaining portion 22 extends slightly beyond the tapered slot 14 (FIG. 4). Further movement of the contact member (FIG. 5) causes the end 24 to enter the slot 14, and the resilience of the end 24 allows it to ride up the tapered sides of the slot.

Any attempt to remove the contact member by moving it towards the open end of the housing 10 causes the end 24 to dig into the material of the housing. At the same time the weakened portion 23 bends slightly until the end of the retaining portion becomes wedged across the aperture. This situation is shown in FIG. 3.

Figure 6:
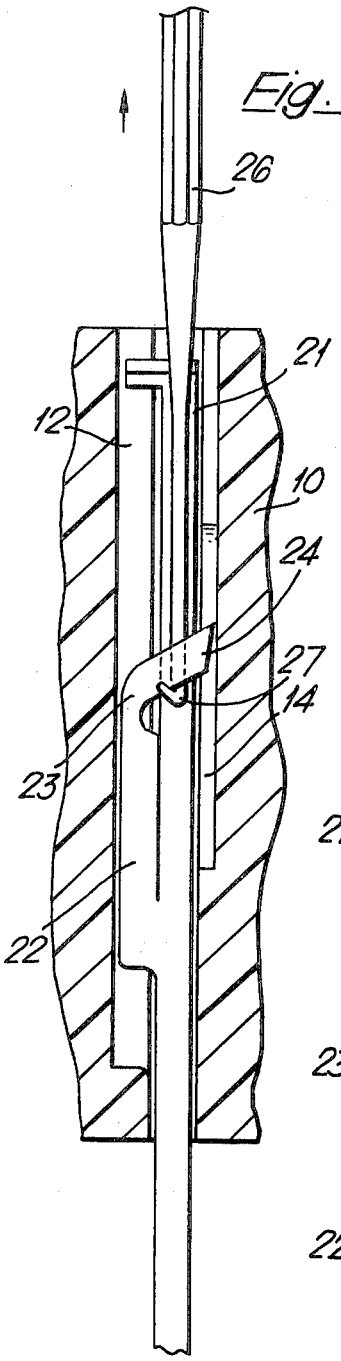
FIG. 6 illustrates the removal of a contact member.

FIG. 6 illustrates the method of removal of a contact member. This requires the insertion into the aperture 12 of a tool 26 having a hooked end 27. The hook is engaged under the end 24 of the contact member, and an upward pull is applied by the tool. This releases the end 24 from the walls and/or base of the slot 14 and allows the contact member to be removed.

Figure 7:
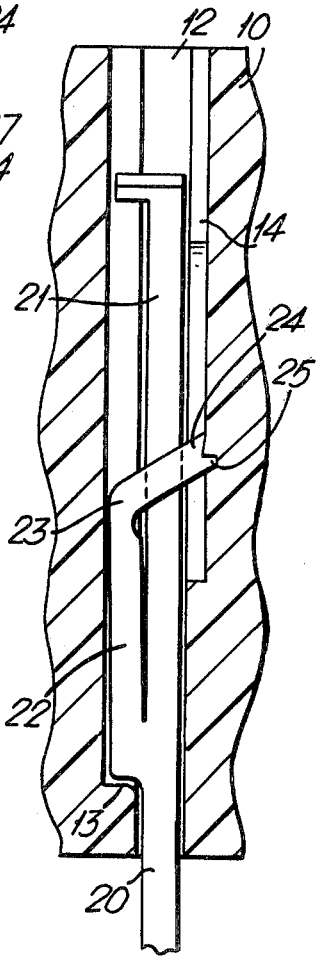
FIG. 7 illustrates a modification to the contact member of FIGS. 1 to 6.

FIG. 7 illustrates a modified contact member intended to prevent failure of the retaining portion due to the application of excessive force. The end 24 of the retaining portion is stepped so that the heel 25 digs into the housing. The remainder of end 24 will come into contact with the base of slot 14 as the end bends about the weakened area 23, and prevent further bending.

The embodiment described above may be modified in various ways. For example, the retaining portion of the contact member may, instead of being bent transversely to the contact portion 21, be bent in the same direction so as to engage part of the centre region of the housing between the two parallel rows of contact members. The slot 14 need not have tapered walls, though this does assist the retaining member to engage the housing. Alternatively, the slot may have parallel walls and the end of the retaining member may be tapered.

The connector need not be an edge connector. Many types of connector exist in which contact members of various shapes are located in apertures in an insulating housing, and the invention may be applied to many of these. In some instances it may be possible to remove a contact by inserting a tool from the bottom of the housing and pushing the retaining member out of engagement with the slot.

What we claim is:

1. An electric connector of the type comprising a housing of electrically insulating material having a plurality of contact members extending parallel to one another and arranged to be inserted and withdrawn from the housing from one end thereof, in which the housing includes, for each contact member, an aperture extending through the housing and defining a retaining shoulder, a contact-locating region, and a slot communicating with the contact-locating region and extending from the said one end of the housing for at least part of the length of that region, and in which contact member includes a terminal portion arranged to project from the end of the housing remote from the said one end, a contact portion arranged to be located in the contact-locating region so as to cooperate with a plug member inserted into the housing from said one end, and a retaining portion having a sharpened end arranged to extend into said slot and shaped so as to become wedged across the aperture to prevent the withdrawal of the contact member through the said one end of the housing.

2. A connector as claimed in claim 1 in which the said slot is formed with the walls adjacent to the contact-locating region inclined towards one another away from said region.

3. A connector as claimed in claim 1 in which the retaining portion of the contact member extends from the terminal portion and is bent to provide an edge capable of engaging said slot.

4. A connector as claimed in claim 3 in which the retaining portion of the contact member is weakened at the point of bending.

5. A connector as claimed in claim 3 in which the free end of the retaining portion is provided with a first part arranged to engage the wall of the slot and a second portion arranged to limit the bending of the retaining portion.

6. In combination an electric connector of the type comprising a housing of electrically insulating material having a plurality of contact members extending parallel to one another and arranged to be inserted and withdrawn from the housing from one end thereof, in which the housing includes, for each contact member, an aperture extending through the housing and defining a retaining shoulder, a contact-locating region, and a slot communicating with the contact-locating region and extending from the said one end of the housing for at least part of the length of that region, and in which each contact member includes a terminal portion arranged to project from the end of the housing remote from the said one end, a contact portion arranged to be located in the contact-locating region so as to cooperate with a plug member inserted into the housing from said one end, a retaining portion having a sharpened end arranged to extend into said slot and shaped so as to become wedged across the aperture to prevent the withdrawal of the contact member through the said one end of the housing and an extraction tool insertable into the aperture in the housing for engagement with the retaining portion of the contact member.

* * * * *